US005833751A

United States Patent [19]

Tucker

[11] Patent Number: 5,833,751

[45] Date of Patent: Nov. 10, 1998

[54] POWDER COATING BOOTH HAVING SMOOTH INTERNAL SURFACES

[75] Inventor: Richard R. Tucker, Terre Haute, Ind.

[73] Assignee: Hoosier Fiberglass Industries, Inc, Terre Haute, Ind.

[21] Appl. No.: 733,519

[22] Filed: Oct. 18, 1996

[51] Int. Cl.[6] ..... B05C 15/00

[52] U.S. Cl. ..... 118/64; 118/309; 118/326; 118/634; 118/DIG. 7

[58] Field of Search ..... 118/64, 326, 634, 118/DIG. 7, 309; 52/309.1, 730.1, 732.2

[56] References Cited

U.S. PATENT DOCUMENTS

| | | | |
|---|---|---|---|
| 4,338,364 | 7/1982 | Kennon et al. | 118/326 |
| 4,471,715 | 9/1984 | Gubler et al. | 118/324 |
| 4,715,314 | 12/1987 | Ramseier et al. | 118/634 |
| 4,764,220 | 8/1988 | Dinkel et al. | 134/6 |
| 4,851,261 | 7/1989 | Gelain et al. | 427/195 |
| 4,852,513 | 8/1989 | Hayes | 118/326 |
| 5,199,989 | 4/1993 | Thies et al. | 118/309 |
| 5,240,504 | 8/1993 | Mazakas | 118/634 |
| 5,259,879 | 11/1993 | Khattab et al. | 118/326 |
| 5,277,713 | 1/1994 | Gelain et al. | 118/64 |
| 5,417,765 | 5/1995 | Otani et al. | 118/314 |
| 5,456,023 | 10/1995 | Farnan | 34/270 |

FOREIGN PATENT DOCUMENTS 2248367 4/1973 Germany .

*Primary Examiner*—Laura Edwards
*Attorney, Agent, or Firm*—H. John Barnett

[57] ABSTRACT

A powder coating booth comprising a pair of identical polycarbonate shells disposed opposite each other to define a coating chamber having smooth, curvilinear internal surfaces to facilitate the recovery and recycle of excess coating powder. Narrowed down end openings are provided to help confine the excess powder. A thermoplastic material such as polyvinyl carbonate or polycarbonate is formed in a large thermoforming machine with vacuum and pressure to fabricate the components of the coating chamber, which may be up to ten feet wide, ten feet tall, and thirty feet long or longer.

6 Claims, 1 Drawing Sheet

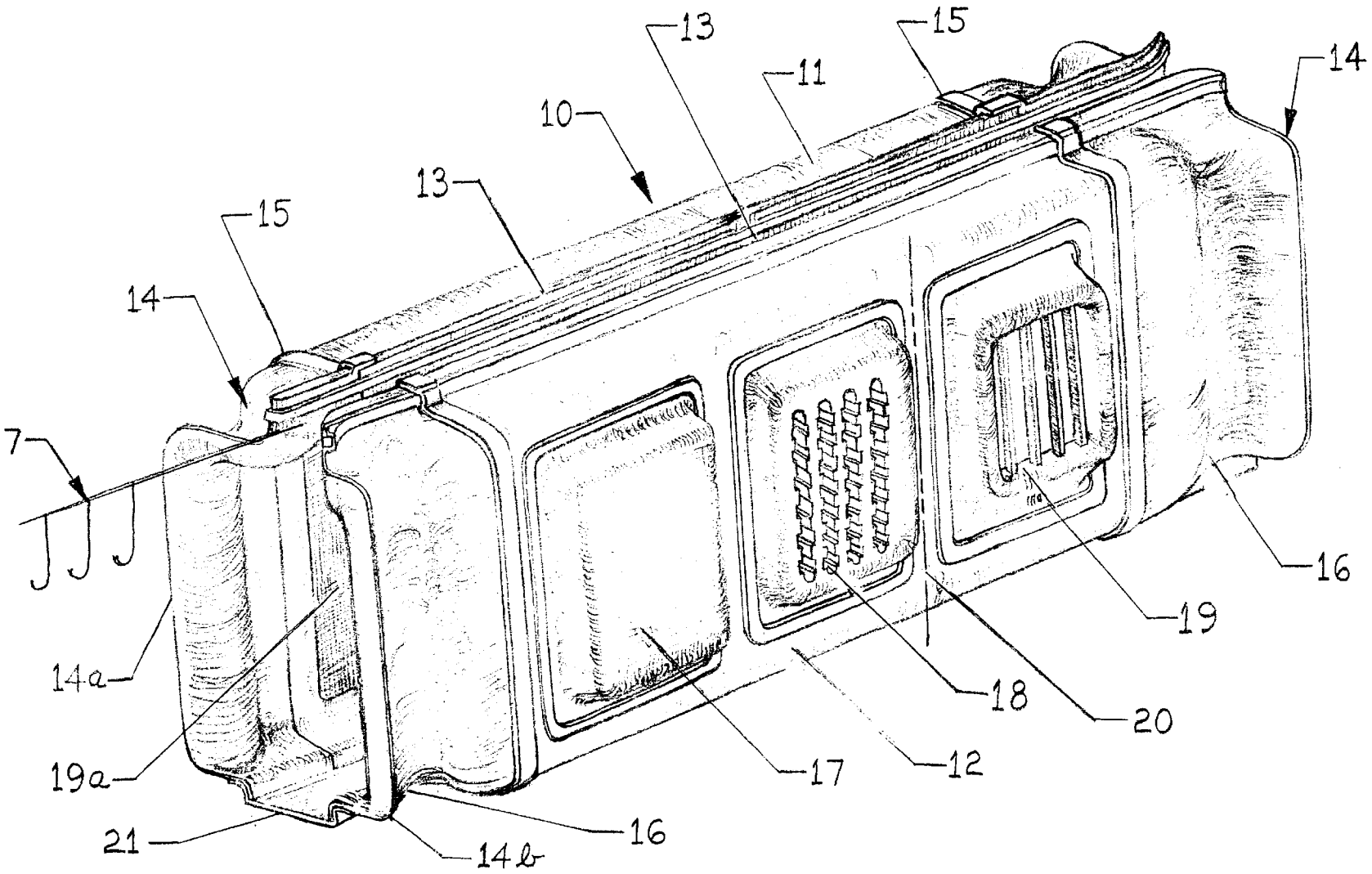
14
16
19
20
18
12
17
15
11
13
10
13
15
14
7
14a
19a
21
16
14b

POWDER COATING BOOTH HAVING SMOOTH INTERNAL SURFACES

BACKGROUND OF THE INVENTION

1. Field of the Invention

This invention relates generally to a powder coating booth for coating articles with electrostatic paint particles in a process sometimes referred to as "electro-coating", or powder painting. More particularly, this invention is directed to a powder coating booth chamber having smooth internal surfaces fabricated from a thermoplastic such as polyvinyl carbonate or polycarbonate formed in a large thermo-forming machine with vacuum and pressure.

The resulting smooth-walled chamber can also be used to replace "clean rooms" required for delicate surgery, drug manufacturing and drug packaging, in which a sterile environment is required. The polycarbonate materials are chemically resistant, lightweight and considerably less expensive than stainless steel which has been typically used for many of the above applications.

The thermo-formed polycarbonate chamber is particularly suitable for use as a powder coating booth in which electrostatically charged paint particles are applied to metal workpieces. In the electrostatic coating process, there is usually a considerable amount of overspray particles which should be collected and recycled to make the process more economical. Also, if the powder coating booth is to be used for coating different colors of paint, it is necessary to first thoroughly clean the inside of the booth to avoid color contamination in successive runs.

2. Description of the Related Art

There are many recent patents directed to various types of booths for powder coating processes. U. S. Pat. No. 4,471,715, issued to Gubler et al, describes a booth having air cleaners in its side walls which can be easily interchanged. The dimensions of the spray coating area can be varied and the filter units can be interchanged with other types of units, such as sprayers. The powder is continuously precipitated from the air by the air filters, and the excess powder is transported from the booth in inclined chutes with a fluidized bed. The material from which the booth is fabricated is probably metal (See: Col 5, lines 21–28 of the above patent).

U. S. Pat. No. 4,851,261, issued to Gelain, et al, describes a rectangular shaped powder coating booth constituted of two main sections which are swingably interconnected. The walls and roof of each half of the booth may be straightened out to become flat surfaces for easy removal of powder residues. The Gelain, et al, booth is also believed to be metal, because the roof and walls are connected by hinges 40. Apparently, Federal Republic of Germany OS #22 48 367 discloses a booth having plastic walls, but the publication employs an electric field for repelling powder away from the walls (See Gelain, et al, Col 1, lines 67, 68 and Col. 2, lines 1, 2).

Ransburg's U. S. Pat. No. 5,456,023, issued to Farnan describes a paint spray booth for automobiles which incorporates a high volume flow of air over the surfaces of the workpiece. The apparatus is retrofitted on existing paint spray booths, which appear to be metal.

Many proposals have been made for cleaning powder coating booths. Examples are found in the following patents:

| Patent Number | Inventor | Date |
|---|---|---|
| 4,764,220 | Dinkel, et al | 1988 |
| 4,852,513 | Hayes | 1989 |
| 5,199,989 | Theis, et al | 1993 |
| 5,240,504 | Mazakas | 1993 |
| 5,417,765 | Otani, et al | 1995. |

The above patents propose a variety of methods for solving the coating powder overspray problem. Dinkel, et al, uses scrapers and blowers. Hayes has a belt and hopper arrangement. Both booths appear to be metal. Theis, et al, has a floor wiping system which includes a wiper member and a scraper, and appears to employ a metal coating booth.

Mazakas describes a flexible liner assembled inside a conventional spray booth to prevent the electrostatic paint powder from adhering to the metal sides of the booth. The liner is replaced for each new color to be painted in the booth. The booth is described as having a metallic walk which attracts the charged paint powder. Otani, et al, describes an elevator to support a cleaning person, who enters the vertically elongated chamber of the coating booth to clean accumulated powder from the inner surfaces. This booth is also believed to be metal.

General Automatic Transfer Company, Fenton, Mo., is offering a polypropylene washer housing to replace steel washer housings. However, it appears that the housing comprises a plurality of flat, polypropylene sheets supported by a metal framework, and that the chamber has many corners. See: *Powder Coating*, August 1996, page 73, advertising.

SUMMARY OF THE INVENTION

This invention is directed to an improved powder coating booth fabricated from a thermoplastic material, such as polyvinyl carbonate or polycarbonate in a double sheet forming process with vacuum and pressure in a large thermo-forming machine. The main chamber of the booth comprises identical, formed units which are assembled together to define a large powder coating chamber having open ends and an extremely smooth inner surface to which the coating powder does not adhere.

The identical units of the main chamber may be up to seventeen and a half feet long, about five feet high and two and a half feet wide. The units are assembled in pairs to define a chamber about five feet wide. Additional pairs of the main chamber units may be assembled end-to-end to define a chamber of any desired length.

A pair of smaller, mirror image end units are provided to partially close the ends of the main chamber to minimize outspray. These end units have a smooth, curved necking down, but the end openings are large enough to allow the workpieces to be conveyed through them in and out of the main chamber.

In the present design, a slit-like opening is provided along the length of the top of the assembled halves to accommodate an endless suspension conveyor for moving the workpieces through the coating booth. The walls of the booth can be provided with apertures in which the spray coating applicators can be inserted into the coating booth. The units may include integrally formed service tubing to simplify installation of the particle coating sprayers and the air circulation conduits, and the coating particle recycle system.

BRIEF DESCRIPTION OF THE DRAWING

The sole FIGURE of the drawing is a perspective view showing a single unit powder coating booth of the invention. The spray coating guns and conveyor system form no part of the present invention, and have been omitted for clarity.

DESCRIPTION OF THE PREFERRED EMBODIMENT

As seen in the drawing, the powder coating booth 10 comprises a pair of complementary units 11 and 12, each of which has strip channels 13 integrally formed in the top portion thereof to accept conveyor rubbing bars 7 to provide smooth conveyor travel longitudinally through the powder coating booth 10. Care is taken in designing the units 11 so that all internal surfaces 13 are continuous and smooth to shed powder coating particles readily. A narrower curved flange portion 14 is provided at each end 15 of each unit 11 and 12. When assembled together, as shown in the drawing, the flange end portions 14 of units 11 and 12 define a narrower neck portion 16 to minimize overspray. Each flange portion 14 comprises a pair of mirror-image, complementary elements, but can also be formed as a single, flange end portion 14.

Sub-units 17, 18 and 19 are shown molded into vertical surfaces 20 of the unit 12. Similar sub-units 17*a*, 18*a* and 19*a* are also molded into the vertical surface 20 of the unit 11. Only sub-unit 19*a* can be seen on its inner surface in the drawing. The sub-units 17, 18, 19, and 19*a* are provided for instant insert or takeout of service equipment, such as spray guns, filters, blowers and the like which are used for a particular application.

A central trough 21 is shown in the drawing and can be used to collect and recycle shed particles of coating material. The shed particles do not adhere to the smooth inside surfaces of the coating booth 10, but collect by gravity in the central trough 21. Central trough 21 may be removable to facilitate cleaning and replacement.

The complementary units 11 and 12 are shown with second ends 15 which are also provided with identical flange end portions 14. Additional units 11 and 12 can be assembled with their ends 15 abutting if it is desired to create a longer coating booth 10. Units 11 and 12 can be provided with narrower flange portions 14 at both ends, as shown in the drawing, if a single pair of units 11 and 12 is long enough to define a powder coating booth 10.

The unit molding requires only three different molded units, the identical units 11 and 12 as shown in the drawing, and the two, mirror-image halves 14*a* and 14*b* of the narrower flange portions 14 at both ends 15 (three). The units which are symmetrical require only one mold for both units 11 and 12. These simple designs of units 11 and 12 can accommodate an infinite number of powder coating booth designs. It is possible to form the narrower flange portion 14 with only a single mold, if its length does not exceed the total depth capability of the present thermo-forming equipment.

Employing presently available thermo-forming equipment, it is possible to form units 11 and 12 at lengths up to about thirty feet, widths of about five feet and heights of about ten feet to define a powder coating booth having effective internal dimensions of 10 feet height, 10 feet width, and about 30 feet length, and multiples thereof (60 feet, etc.).

The thermo-forming equipment permits great versatility in the specific design of chamber walls. For example, longitudinal, jointed vest pipe sections may instead be integrally formed as two half sections with less joints, and no transverse sections to catch dirt. An important feature of the new chamber design is that all internal surfaces are smooth and gradually change direction so that there are no sharp corners or pockets to catch and retain dirt or coating powder.

An extra advantage obtained by the practice of the subject invention is the shipping economy realized by nesting the identically formed halves of the powder coating chamber. The complementary units 11 and 12 are fabricated on the same mold, so that units 11 and 12 can be nested for shipment up to a number limited only by the shipping carrier's capacity. The narrower flange portions 14 which form the ends 15 comprise mirror image halves 14*a* and 14*b*, which also may be nested for shipping.

When the powder coating booth 10 is assembled at its destination, plastic bolts and washers (not shown) are used, so that all internal surfaces of the coating booth 10 are smooth and corrosion resistant. The plastic bolts project externally to attach the booth 10 to a suitable support frame (not shown).

Recycling excess coating powder for reuse is greatly improved by the smooth, curvilinear surface of the powder coating booth of the invention. Cleaning of the booth is also much easier, and much less frequent.

What is claimed is:

1. A powder coating chamber having smooth, curvilinear internal surfaces comprising:

a pair of identical, thermoformed, plastic shells disposed opposite each other to define a coating chamber having a smooth, curvilinear bottom, side and top walls, and two ends, each of said ends having a flanged end portion having an opening therein, each of said end openings connected to a corresponding end of the coating chamber, said end openings having smooth, curvilinear internal surfaces and having a narrower end opening and a larger end, said larger end being connected to an end of said coating chamber.

2. The powder coating chamber of claim 1, further comprising a plurality of identical, thermoformed plastic shells and end portions disposed end to end to define a longer coating chamber.

3. The powder coating chamber of claims 1 and 2, wherein the plastic shells and end portions consist essentially of polyvinyl carbonate.

4. The powder coating chamber of claims 1 and 2, wherein the plastic consists essentially of polycarbonate.

5. The powder coating chamber of claim 1, further comprising a series of access ports integrally formed in the side walls of the plastic shells.

6. The powder coating chamber of claim 1, wherein the top walls of the opposing shells do not meet at the top to define a long, narrow opening through which a workpiece conveyor extends into the chamber to suspend and convey a workpiece through said chamber.

* * * * *